US005661868A

United States Patent [19]

Panagakos et al.

[11] Patent Number: 5,661,868

[45] Date of Patent: Sep. 2, 1997

[54] PORTABLE, COLLAPSIBLE BROOM

[76] Inventors: D'Ann S. Panagakos, 7266 Pajarito Rd. NE.; Jo Beth Aldrich, 1504 Salt River Loop NE.; Peter E. Panagakos, 7266 Pajarito Rd. NE., all of Rio Rancho, N. Mex. 87124

[21] Appl. No.: 726,087

[22] Filed: Oct. 4, 1996

[51] Int. Cl.[6] ..... A46B 15/00; A47L 13/52

[52] U.S. Cl. ..... 15/184; 15/144.4; 15/257.2

[58] Field of Search ..... 15/104.8, 144.3, 15/144.4, 184, 257.2, 185

[56] References Cited

U.S. PATENT DOCUMENTS

| | | | |
|---|---|---|---|
| 1,185,732 | 6/1916 | Swayne | 15/144 A |
| 1,466,454 | 8/1923 | Mock | 15/184 X |
| 1,579,279 | 4/1926 | Cave | 15/184 X |
| 2,553,727 | 5/1951 | Schlutz . | |
| 2,792,697 | 5/1957 | Gingold | 15/184 X |
| 3,029,455 | 4/1962 | Siculan . | |
| 3,153,252 | 10/1964 | Ricciardi | 15/144.4 |

FOREIGN PATENT DOCUMENTS

| | | | |
|---|---|---|---|
| 246712 | 11/1987 | European Pat. Off. | 15/144.4 |
| 2611566 | 9/1988 | France | 15/144.4 |
| 119422 | 3/1927 | Switzerland | 15/104.8 |
| 590855 | 7/1947 | United Kingdom | 15/144.4 |

*Primary Examiner*—Mark Spisich

*Attorney, Agent, or Firm*—Robert W. Becker & Associates

[57] ABSTRACT

A portable, collapsible broom is provided. The broom has a telescoping handle that is movable between a fully extended position and a collapsed position. A mechanism is provided for maintaining the handle in the fully extended position thereof as well as in the collapsed position thereof. A brush portion is disposed at one end of the handle, and a dust pan is detachably carried by the handle. A flap is hingedly connected to the dust pan such that in a closed position the dust pan and the flap cover the brush portion.

17 Claims, 2 Drawing Sheets

PORTABLE, COLLAPSIBLE BROOM

BACKGROUND OF THE INVENTION

The present invention relates to a portable, collapsible broom.

A collapsible broom is known from U.S. Pat. No. 3,029,455, Siculan. This known broom can be used only in the extended position, and provides unsatisfactory means for holding the tapered handle sections in their extended state. U.S. Pat. No. 2,553,727, Schlutz, provides a detachable dust pan. Unfortunately, this known dust pan provides no means for covering the bristles of a broom so that the broom can be transported in such a way that dirt and dust will not be spread around.

It is therefore an object of the present invention to provide an improved portable, collapsible broom that can be used either in a fully extended position or in a collapsed position as a whisk broom, whereby means are provided for adequately holding the handle of the broom in either the fully extended position or in the collapsed position, and furthermore wherein means are provided for covering a brush portion of the broom so as to protect the surroundings from becoming dirty from the brush portion during transport of the broom.

SUMMARY OF THE INVENTION

This object is realized by the broom of the present invention, which comprises:

a telescoping handle means that is movable between a fully extended position and a collapsed position; means for maintaining the handle means in the fully extended position thereof as well as in the collapsed position thereof; a brush portion disposed at one end of the handle means; a dust pan that is detachably carried by the handle means; and a flap hingedly connected to the dust pan such that in a closed position the dust pan and the flap thereof cover the brush portion.

The broom of the present invention as defined above has several advantages. First of all, the broom can either be used in a fully extended position as a regular broom or can be collapsed so that it can be used as a whisk broom. In addition, means are provided to ensure that the handle means of the broom are securely held in either the extended position or in the collapsed position. Furthermore, so that the broom can easily be transported such as in a car, either in the extended position or in the collapsed position, or even in a brief case, the broom is provided with means for covering the brush portion so that, for example, the brief case or car or anything else in which the broom is transported will not become dirty from the brush portion.

To provide the telescoping handle means, the latter can comprise a plurality of handle sections that telescope within one another. Several alternatives can be provided for maintaining the handle means in the proper position. For example, grooves can be provided in inner ones of the handle sections, with outer ones of the handle sections being provided with cooperating projections. In particular, a given one of the inner handle sections can be provided with a longitudinally extending first groove and a lateral second groove that communicates with the first groove, wherein a cooperating outer handle section can be provided with the aforementioned projection, which is guided in the first and second grooves. In addition, the lateral second groove can be provided with a bulge for retaining the projection of the cooperating outer handle section in the second groove.

As an alternative, the means for maintaining the handle means in position can comprise spring-biased pin means disposed in inner ones of the handle section, with cooperating holes being disposed in outer ones of the handle sections. In particular, each of the inner handle sections can be provided with a strip spring that urges a pin means of that handle section outwardly.

As a further alternative, the means for maintaining the handle means in position can comprise cooperating thread means on inner and outer ones of the handle sections.

The handle sections can also be provided with reinforcing means, for example in the form of a plurality of longitudinally extending grooves in each of the handle sections.

The dust pan can be provided with means for snapping the dust pan onto the handle means. For example, such snapping means can comprise an extension that has an essentially semicircular cross-sectional configuration. The dust pan can also be provided with a cutout adjacent to the extension for receiving the handle means. In addition, the dust pan and/or the flap thereof can be provided with means for holding the flap in a closed position. For example, such holding means can comprise a strap that is secured to the dust pan and is releasably attached to the flap. Alternatively, or in addition thereto, a bulge can be disposed on either the dust pan or the flap for cooperating with the other of the flap and the dust pan.

Finally the means for maintaining the handle means in position can also be adapted to maintain the handle means in one or more positions that are intermediate the aforementioned extended and collapsed positions.

Further specific features of the present invention will be described in detail subsequently.

DESCRIPTION OF PREFERRED EMBODIMENTS

Figure 1:
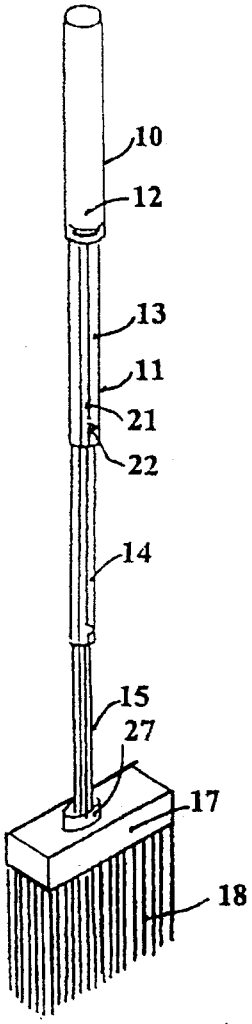
FIG. 1 shows one exemplary embodiment of the inventive collapsible broom.
Figure 4:
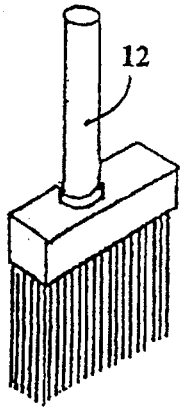
FIG. 4 shows the broom of FIG. 1 in a collapsed state.

Referring now to the drawings in detail, FIG. 1 illustrates one embodiment of the portable collapsible broom of the present invention, with this broom being generally indicated by the reference numeral 10. This broom comprises a telescoping handle means 11, which can be moved between the fully extended positioned illustrated in FIG. 1 to provide a long-handle broom, and the collapsed state illustrated in FIG. 4 wherein the broom now becomes a whisk broom. The handle means 11 comprises a number of handle sections, and in the embodiment illustrated in FIG. 1 comprises four such handle sections 12, 13, 14 and 15. In this embodiment, the largest diameter handle section 12 is shown at the top, with the handle sections 13, 14 and 15 becoming increasingly smaller in diameter so that when the handle means 11 is collapsed into the position shown in FIG. 4, the top, larger diameter handle section 12 will be on the outside. The reverse situation could also exist. In other words, the largest diameter handle section could be at the bottom.

The handle means 11 also comprises a brush portion 17, which is connected to the bottom end of the handle means, and in particular to the bottom handle section 15 thereof. The brush portion 17 is provided with bristles 18.

Figure 2:
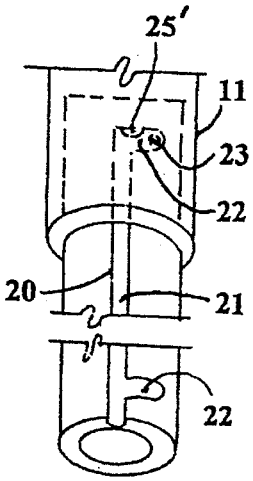
FIG. 2 is a partial view of the handle means of the broom of FIG. 1 showing one way of locking the handle sections in place.
Figure 5:
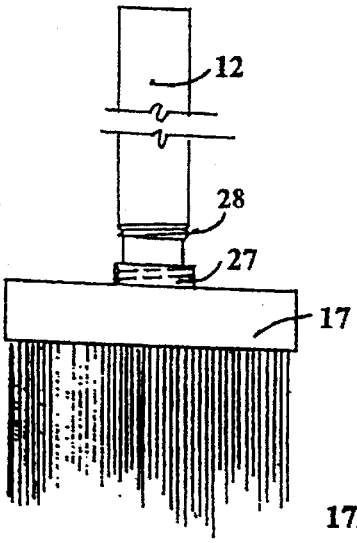
FIG. 5 shows an alternative means for locking the handle in a collapsed position.

The handle means 11 is provided with means 20 for maintaining the handle sections 12–15 thereof in the fully extended state, in the fully collapsed state, and optionally in intermediate handle extension states or lengths. As can be seen particularly clearly in FIGS. 2 and 3, the means 20 for maintaining the handle means 11 in position comprises a longitudinally extending groove or slot 21 in each of the inner handle sections 13, 14 and 15. In addition, lateral grooves or slots 22 that communicate with the longitudinal extending grooves or slot 21 are provided near the upper and lower ends of the longitudinal grooves 21 of the sections 13 and 14, and a lateral groove 22 is also provided at least in the upper end of the longitudinally extending groove 21 of the lower most section 15. The grooves 21 and 22 cooperate with a projection or nipple 23 that is provided near the lower end and on the inner periphery of each of the handle sections 12, 13 and 14 (see FIG. 3). The means 20 for maintaining the handle sections 12–15 of the handle means 11 in position functions as follows. For example, to convert the broom 10 from the fully extended position illustrated in FIG. 1 to the collapsed, whisk broom position illustrated in FIG. 4, each of the handle sections 12, 13 and is twisted relative to the handle section 13, and 15 disposed therebelow in order to move the projection 23 out of the respective lateral groove 22 and into the associated longitudinally extending groove 21. The entire handle means 11 can then be pushed together or collapsed into the position shown in FIG. 4. To maintain the broom in this collapsed position, the outer handle section 12 is secured to the portion 27 of the brush portion 17. This can be accomplished in one of several ways. For example, as indicated in FIG. 5, an external thread 28 provided at the lower end of the outer handle section 12 can be screwed into an internal thread of the part 27 of the brush portion 17. Alternatively, any other suitable connection means could also be used, including a projection and slot arrangement similar to that used for the remainder of the handle means 11. At any rate, it can be seen that such connection means will operate to maintain the broom 10 in a collapsed state so that the broom can be used as a whisk broom or merely facilitate storage and transport of the broom in a small space.

Figure 3:
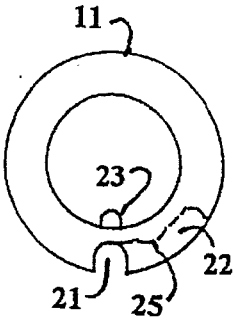
FIG. 3 is a cross-sectional view through the handle to again illustrate the locking means.

As can be seen from FIG. 3, in order to facilitate holding the projection 23 in place in the lateral groove 22, it is expedient to provide the lateral groove 22 with a bulge 25. Since the diameter of the projection 23 preferably at least approximates the diameter of the longitudinally extending groove 21 and in particular the lateral groove 22, when the projection 23 is forced past the bulge 25, for example by compressing the same slightly, the projection 23 will be securely held in the lateral groove 22 until the handle section on which the projection 23 is provided is again twisted past the bulge 25 in order to reach the longitudinally extending groove 21. Although in the embodiment illustrated in FIG. 3 the bulge 25 has been shown on the inner surface of the groove 22 of the pertaining handle section of the handle means 11, such a bulge 25 could also be provided on a different surface of the lateral groove 22, such as on one of the surfaces illustrated in FIG. 2.

As illustrated in FIGS. 13–17, a detachable dust pan 30 is provided that not only makes it more practical to use the broom but also provides a means to cover the brush portion 17 when the broom 10 is not in use and/or is being transported, such as in the vehicle or even the brief case of a user. The dust pan 30 has an extension 31 that has, for example,, a semicircular cross sectional shape to allow the dust pan 30 to be snapped onto the handle means 11 of the broom 10. In particular it is contemplated that the dust pan 30 will be snapped onto the handle means 11 in the collapsed state of the broom 10, whereby in the embodiment of FIGS. 1–5 the extension 31 of the dust pan 30 would be snapped onto the handle section 12 of the handle means 11. To facilitate snapping of the dust pan 30 onto the broom 10, the dust pan is provided with a cutout 32 in the vicinity of the extension 31 to accommodate the handle means 11.

To close off the dust pan and thereby cover the brush portion 17 for transportation purposes, a flap 34 is provided that is, of course, also utilized in conjunction with the dust pan 30 during sweeping. The flap 34 is connected to the bottom of the dust pan 30 by hinge means 35. The hinge means can be any suitable hinge means, and could include hinge portions 35 on both the flap 34 and the dust pan 30 that are then interconnected by a pin. To hold the flap 34 in either the closed position shown in FIG. 14, or in the open position shown in FIGS. 15 and 16, a strap 36 is provided on one or both sides of the dust pan 30. Such a strap can, for example, be secured to the dust pan 30 in any suitable fashion, and then can be releasably attached to the flap 34 by being snapped thereto or by Velcro means. As an alternative or in addition to the strap or straps 36, the flap 34 can be provided with a protection or bulge 37 (see FIG. 16) on one or both sides that when the flap 34 is closed will slightly expand the sides of the dust pan 30 and will then remain in place in the closed position due to the tight fit between the bulge 37 and the dust pan. Instead of being disposed on the flap 34, the bulges 37 could also be disposed on the inner surfaces of the sides of the dust pan 30.

In the embodiment illustrated in FIGS. 1–5, a first means 20 for maintaining the handle means 11 in position was illustrated and described. However, other means for maintaining the handle means in position are also conceivable. For example, reference is now made to FIGS. 6–8 wherein another broom 10A of this invention is illustrated and comprises an alternative means 20A for maintaining the handle means 11A in position. Parts of the broom 10A that are similar to the broom 10 of FIGS. 1–5 are indicated by like reference numerals followed by the reference letter "A".

Figure 6:
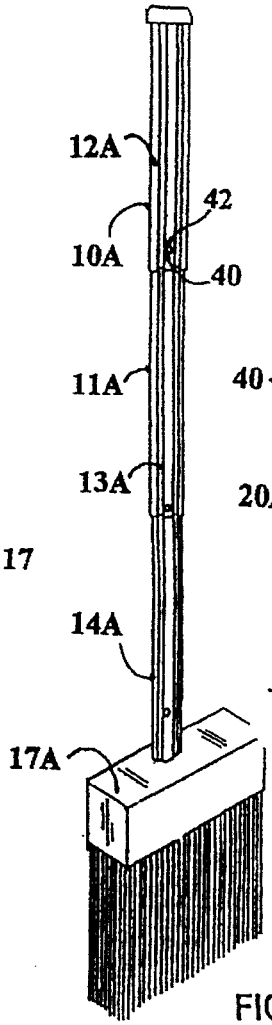
FIG. 6 shows another exemplary embodiment of the inventive collapsible broom.
Figure 7:
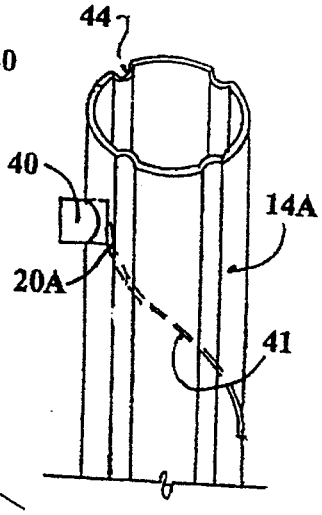
FIG. 7 shows an alternative locking means for the embodiment of FIG. 6.
Figure 8:
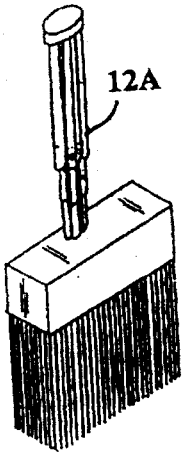
FIG. 8 shows the broom of FIG. 6 in a collapsed state.
Figure 9:
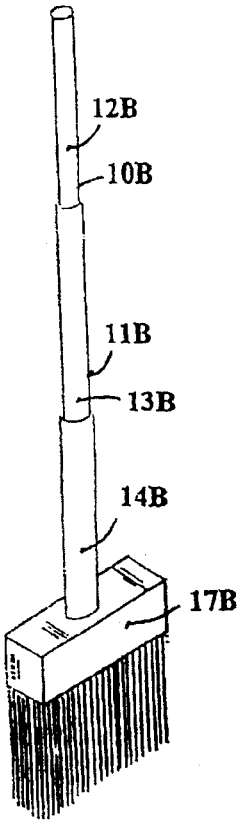
FIG. 9 illustrates a further exemplary collapsible broom of the present invention.
Figure 10:
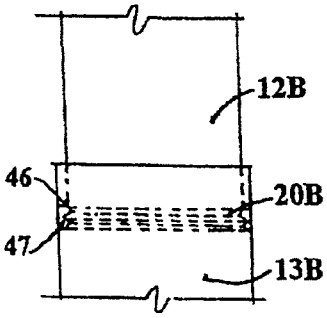
FIGS. 10 and 11 show a possible locking means for the broom of FIG. 9.
Figure 11:
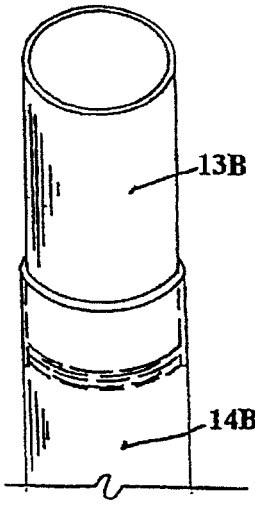
Figure 12:
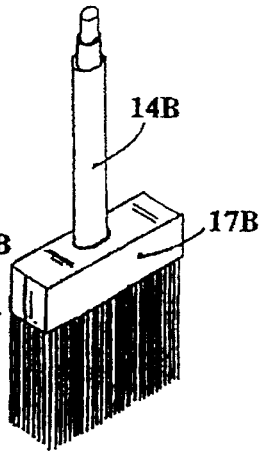
FIG. 12 shows the broom of FIG. 9 in a collapsed state.
Figure 13:
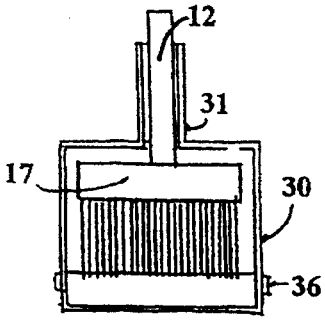
FIG. 13 illustrates one exemplary embodiment of the dust pan for the inventive collapsible broom.
Figure 14:
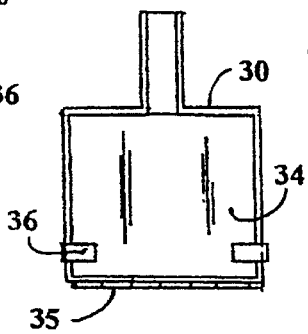
FIG. 14 shows the flap of the dust pan in a closed state.
Figure 15:
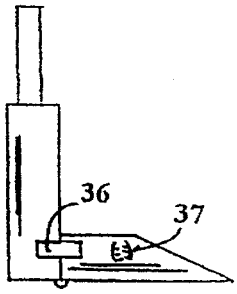
FIG. 15 shows the flap of the dust pan in an open state.
Figure 16:
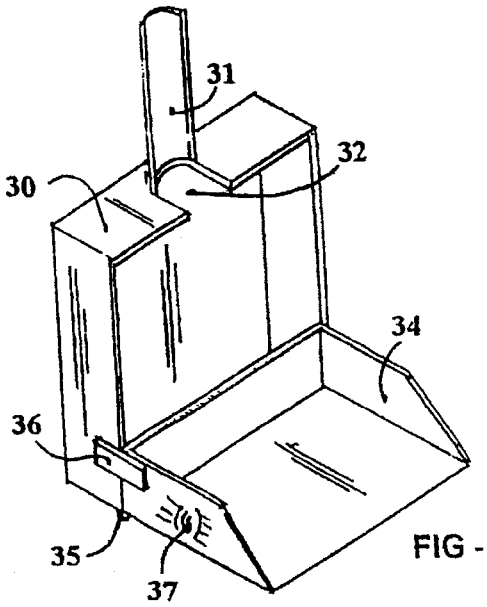
FIG. 16 is a perspective view of the dust pan in an open state.
Figure 17:
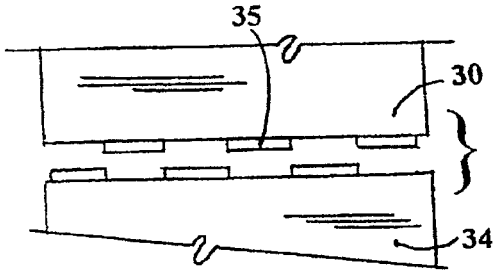
FIG. 17 shows an exemplary hinge means for the dust pan.

Instead of the groove and projection arrangement of the means 20 of the embodiment of FIGS. 1–5, the means 20A of the embodiment of FIGS. 6–8 for maintaining the handle means 11A in either the extended or retracted position comprises a pin and spring arrangement. For example, as can be seen in FIG. 7, the means 20A comprises a locking pin 40 that is spring biased by a spring 41, such as a spring strip. The spring 41 urges the locking pin 40 outwardly so that when the handle sections 12A, 13A and 14A are either in the collapsed or retracted position of FIG. 8, or in the extended position of FIG. 6, the locking pin 40 will extend through holes 42 provided in the handle sections to thereby secure such handle sections in the desired position. In the collapsed position of FIG. 8, the locking pin 40 will extend through both the handle section 13A as well as the handle section 12A.

In the embodiment illustrated in FIG. 6–8, the handle sections 12A–14A of the handle means 11A have a fluted or grooved construction that is indicated generally by the reference numeral 44. This is intended to provide a reinforcement for the handle means. Such a reinforcing construction can, of course, be used for any of the embodiments of the present invention as desired.

A further alternative means for maintaining the handle means in position is illustrated by the means 20B of the broom 10B of the embodiment of FIGS. 9–12. Again, the parts of this broom 10B that are similar to the broom 10 of FIGS. 1–5 are indicated by like reference numerals followed by the reference letter "B".

In this embodiment, the means 20B for maintaining the handle means 11B in position comprises threads 46 and 47 on the handle sections 12B, 13B and 14B. In particular, in this embodiment the diameter of the handle sections increase from the top to the bottom, so that in the retracted position shown in FIG. 12, the upper section 12B is mostly within the following handle section 13B which in turn is held mostly within the bottom handle section 14B. In the extended position, an external thread 46 near the bottom of the upper handle section 12B engages an internal thread 47 near the top of the handle section 13B. Similarly, in a retracted position the external thread 46 of the handle section 12B will engage an internal thread (not illustrated) of the brush portion 17B, similar to the situation illustrated in FIG. 5.

Although specific means 20 have been provided for the various embodiments, suitable combinations of these embodiments could also be provided as appropriate. In addition, where as these various embodiments of the brooms 10–10B illustrate specific numbers of handle sections, such as four handle sections for the broom 10 and three handle sections for the brooms 10A and 10B, a greater or lesser number of handle sections can be provided for any of the illustrated embodiments.

Although the various components of the brooms 10–10B can be made of any suitable material, the preferred material for at least most of the broom components is plastic.

The present invention is, of course, in no way restricted to the specific disclosure of the specification and drawings, but also encompasses any modifications within the scope of the appended claims.

We claim:

1. A portable, collapsible broom, comprising:

a telescoping handle means that is movable between a fully extended position and a collapsed position;

means for maintaining said handle means in said fully extended position thereof as well as in said collapsed position thereof;

a brush portion disposed at one end of said handle means;

a dust pan that is detachably carried by said handle means; and a flap hingedly connected to said dust pan such that in a closed position said dust pan and said flap thereof cover said brush portion.

2. A broom according to claim 1, wherein said handle means comprises a plurality of handle sections that telescope within one another.

3. A broom according to claim 2, wherein said means for maintaining said handle means in position comprises groove means in inner ones of said handle sections, and cooperating projections in outer ones of said handle sections.

4. A broom according to claim 3, wherein a given one of said inner handle sections is provided with a longitudinally extending first groove and a lateral second groove that communicates with said first groove, and wherein a cooperating outer handle section is provided on an inner surface thereof with said projection, which is guided in said first and second grooves.

5. A broom according to claim 4, wherein said lateral second groove is provided with a bulge for retaining said projection of said cooperating outer handle section in said second groove.

6. A broom according to claim 2, wherein said means for maintaining said handle means in position comprises spring-biased pin means disposed in inner ones of said handle sections, and cooperating holes disposed in outer ones of said handle sections.

7. A broom according to claim 6, wherein each of said inner handle sections is provided with a strip spring that urges a pin means of that handle section outwardly.

8. A broom according to claim 2, wherein said means for maintaining said handle means in position comprises cooperating thread means on inner and outer ones of said handle sections.

9. A broom according to claim 2, wherein said handle sections are provided with reinforcing means.

10. A broom according to claim 9, wherein said reinforcing means is in the form of a plurality of longitudinally extending grooves in each of said handle sections.

11. A broom according to claim 2, wherein said dust pan includes means for snapping said dust pan onto said handle means.

12. A broom according to claim 11, wherein said snapping means comprises an extension that has an essentially semi-circular cross-sectional configuration.

13. A broom according to claim 12, wherein said dust pan furthermore includes a cutout adjacent said extension for receiving said handle means.

14. A broom according to claim 11, wherein at least one of said dust pan and said flap thereof is provided with means for holding said flap in said closed position.

15. A broom according to claim 14, wherein said holding means comprises at least one strap that is secured to said dust pan and is releaseably attached to said flap.

16. A broom according to claim 14, wherein said holding means comprises at least one bulge disposed on one of said dust pan and said flap for cooperating with the other of said flap and said dust pan.

17. A broom according to claim 2, wherein said means for maintaining said handle means is also adapted to maintain said handle means in at least one position intermediate said extended and collapsed positions thereof.

* * * * *